United States Patent [19]

Bozek

[11] Patent Number: 4,757,799

[45] Date of Patent: Jul. 19, 1988

[54] ARCHERY BOX WITH LEVERAGED BENDING BOWSTRING AND SEPARATE LAUNCHING BOWSTRING

[76] Inventor: John W. Bozek, 6093 Waterfront Dr., Waterford, Mich. 48095

[21] Appl. No.: 871,793

[22] Filed: Jun. 9, 1986

[51] Int. Cl.[4] ..... F41B 5/00

[52] U.S. Cl. ..... 124/23 R; 124/DIG. 1

[58] Field of Search ..... 124/23 R, 24 R, DIG. 1

[56] References Cited

U.S. PATENT DOCUMENTS

| | | | |
|---|---|---|---|
| 4,294,221 | 10/1981 | Bryant | 124/23 R |
| 4,471,747 | 9/1984 | Nishioka | 124/23 R |
| 4,478,202 | 10/1984 | Anderson | 124/23 R |
| 4,530,342 | 7/1985 | Simo | 124/24 R |

*Primary Examiner*—Richard C. Pinkham
*Assistant Examiner*—Benjamin Layno
*Attorney, Agent, or Firm*—John R. Benefiel

[57] ABSTRACT

An archery bow having side by side launching and bending bowstrings, the bending bowstring drawn one or more times as a preliminary to firing of the bow to bend the bow limbs, which bent limbs are released only at firing after drawing and releasing both bowstrings, to accelerate an arrow nocked in the launching bowstring. Bending mechanisms are mounted to the bow handle and are operated by the bending bowstring, to wind up a pair of load cables attched to the limb tips onto capstan elements released at firing. A mechanical advantage is achieved in the bending mechanisms to reduce the effort required to bend the limbs by drawing of the bending bowstring.

19 Claims, 5 Drawing Sheets

ARCHERY BOX WITH LEVERAGED BENDING BOWSTRING AND SEPARATE LAUNCHING BOWSTRING

BACKGROUND OF THE INVENTION

This invention concerns archery bows, and more particularly concerns an arrangement for increasing the leverage able to be exerted by the user in bending the limbs by drawing of a bowstring.

An archery bow conventionally consists of a bow member having resilient limbs connected by a bowstring, which are bent by drawing of the drawstring, the energy of the bent limbs released to accelerate the arrow when the bow is fired.

The effort exerted by the user has in conventional bows corresponded to the maximum acceleration forces exerted on the arrow. Compound bows have been developed which reduce the effort required to hold the bowstring at full draw, but the peak effort required still corresponds roughly to the maximum arrow accelerating forces applied by the bow.

U.S. Pat. No. 4,478,202 describes an attempt at incorporating a force multiplication mechanism to allow leveraging of the drawing effort. However, it is believed that in that design the actual sizing of the various components would be impractical, that a sudden pronounced increase in felt draw resistance would occur at full draw, and unbalanced limb bending would occur, each of these latter two factors adversely affecting accuracy.

SUMMARY OF THE INVENTION

The present invention provides a draw force leveraging effect to greatly increase the arrow accelerating impulse force for a given drawing peak effort to a level greater than the maximum draw force effort exerted, contrary to that achieved in conventional designs. This is achieved by use of a pair of bowstrings strung side by side, a bending bowstring strung parallel to a launching bowstring, the bending drawstring repeatedly drawn to progressively bend the limbs. The limbs are held in their partially bent position after each drawing stroke of the bowstring by latching means means included in a pair of bending mechanisms operated by the drawing motion of the bending bowstring. The fully bent bow limbs are released at firing of the bow after a final drawing movement of the bending bowstring, which final movement produces full bending of the limbs. The final drawing motion occurs simultaneously with drawing of the launching bowstring, and the energy of the bent limbs is released into an arrow nocked on the launching bowstring.

The bending bowstring passes about a pulley mounted on each limb tip, each end thereof extending back to be connected to a bending segment reel included in each bending mechanism, and rotatably mounted on an axle also included in the mechanism and in turn supported on respective brackets fixed extending to the rear and adjacent either side of the bow handle section.

Each bending segment reel has an intermittently engaged driving connection to its associated axle, acting to rotate a respective axle only when the bending bowstring is under tension, as when being drawn or held drawn. A pair of rotary capstans are each connected to rotate with one of the axles, and each winds up one of a pair of load cables connected to a respective limb tip at one end and to a capstan at the other end to be wound thereon.

The bending mechanisms each include the latching means previously mentioned, whereby the associated axle is latched in each progressive step of wind-up rotation, by the action of a connected latch plate and latch pawl, so that the capstan and the load cables are held in a partially wound condition, thereby holding the limbs in their partially bent position after the bending operation has begun. The latching plates are released to also free the limbs, upon the full final draw of the bending bowstring to allow release of the limbs at firing.

In the preferred embodiment, each end of the launching bowstring also passes around a limb mounted pulley and extends to be received over one of a pair of launching reels, each rotatably received over a respective one of the axles.

Each launching reel has a length of launching bowstring would thereon initially, to provide a payout of the prewound launching bowstring at the final draw to allow use of a short limbed bow member. The launching reels are spring biased to rotate reversely to the direction of the load cable wind up of the capstans, to also function to take up the launching bowstring slack developed as the limbs are bent by the load cables to maintain the launching bowstring taut as bending progresses.

The launching reels also function to transfer a portion of the energy of the limbs into the return movement of the launching bowstring, and for this purpose, are rotated into a driving engagement with the capstan and axle by drawing and consequent unwinding of the launching bowstring when the bow is to be fired.

The spring back of the limbs at release thus acts on the launching bowstring directly and by the driving of the launching reels by the capstans acted on by the load cables and axles, to rapidly return the launching bowstring to its rest position, and in so doing, accelerate the fired arrow nocked on the launching bowstring.

In a simplified embodiment, the launching reels are not employed, and the launching bowstring is attached directly to the limb tips, so that limbs act only directly on the launching bowstring at firing.

DETAILED DESCRIPTION

In the following detailed description, a specific embodiment will be described, and particular terminology employed for the sake of clarity, but it should be understood that the invention is not so limited, and that many variations and alternate structures are possible.

Figure 1B:
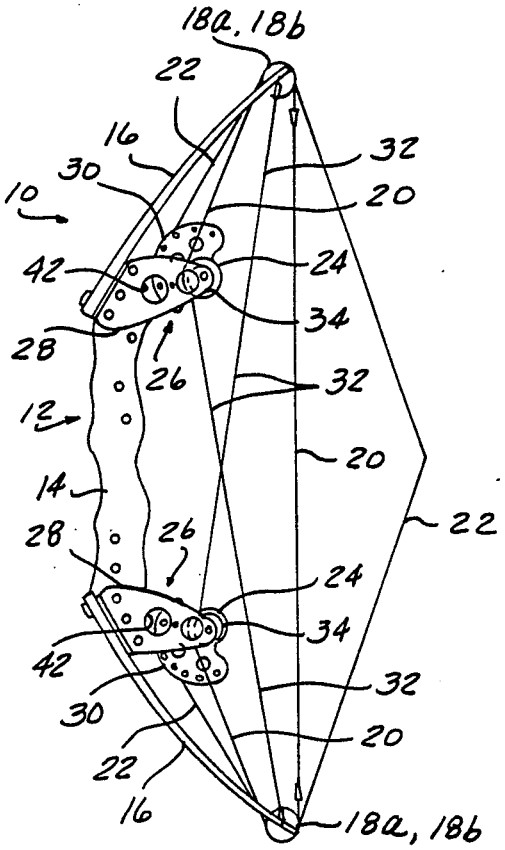
FIGS. 1*a* and 1*b* are side elevational views of an archery bow according to the present invention, showing successive positions of the parts with the bending bowstring undrawn (1*a*) and drawn during bending of the limbs by successive drawing of the bending bowstring (1*b*).
Figure 1A:
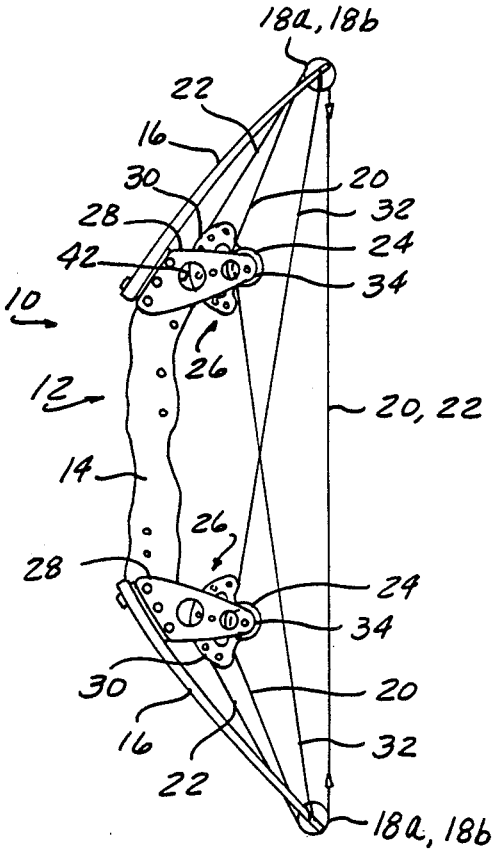

FIG. 1*a* depicts the basic arrangement of parts in the archery bow 10 according to the present invention, including a bow member 12 having a central handle section 14 and opposite resilient limbs 16 attached to either end thereof.

Rotatably mounted to the tip of each limb 16 are a pair of rotary pulleys 18, around one of which pass a "launching" bowstring 20 and a "bending" bowstring 22.

The "launching" bowstring is employed to launch the arrow (not shown) at firing and the bending bowstring 22 is employed to preload the archery bow 10 by progressively bending the limbs 16 prior to firing by a series of preliminary preloading draws, as shown in FIG. 1*b*.

In the preferred embodiment, each end of the launching bowstring 20 is wound around and connected to a respectoive one of a pair of launching reels 24, included in each of a pair of bending mechanisms 26, mounted to brackets 28 affixed to the inside of the bow member handle section 14.

Each end of the bending bowstring 22 is received around and fixed to a respective one of a pair of bending segment reels 30, one of which being also included in each bending mechanism 26.

A pair of load cables 32, are each fixed at one end to the tip of a respective limb 16 and at the other to the periphery of a capstan 34 included in the opposite bending mechanism 26. The connection of each load cable 32 to the capstan 34 is such as to be in the opposite sense to the connections of the bending bowstring 20 to the launching reels 24 and the bending bowstring 22 to the bending segment reels 30.

Thus, as the upper of segment reels 30 are rotated clockwise from an initial position by drawing and unwinding of the bending bowstring 22, as shown in FIG. 1*a*, the capstans 34 are also rotated thereby in the same direction by an intermittently established driving connection to be described, but act to wind up the connected load cables 32 and bend the limbs 16 as shown. Due to the great difference in size between the bending segment reels 30 and the capstans 34, a corresponding mechanical advantage is realized so to greatly reduce the effort required to produce a corresponding tension in the load cables 32.

Upon relaxing of the tension in bending bowstring 22, the driving engagement of each of the bending segment reels 30 is interrupted, and they are rotated to a return position by a spring bias, while the capstans 34 remain held in the partially wound position by operation of latching means, both included in the bending mechanisms 26 as will be described.

The bending operation is contemplated as being repeated one or more times to in effect accumulate a sufficient length of drawing motion of the bowstring 22 acting with the mechanical advantage afforded by the bending mechanisms 28, so as to progressively bend the limbs 16 to an increasingly flexed condition. This imposes a greater tension in load cables 32 with each of one or more successive drawing motions of the bending bowstring 22.

During this operation, the slack which would otherwise develop in the launching bowstring 20 is taken up by reverse rotation of each of the launching reels 24, also acted on by a spring bias means urging opposite rotation as viewed in FIGS. 1*a* and 1*b*, such that the launching bowstring 20 remains taut, as indicated in FIG. 1*b*, throughout the preliminary bending stages.

Upon completion of the preliminary, bending operations, both the launching bowstring 20 and the bending bowstring 22 are drawn, with an arrow nocked only to the launching bowstring 20.

By an arrangement included in each bending mechanism, as described hereinafter, completion of a predetermined number such as two preliminary limb bending draws, and upon a final drawing of bending bowstring 22, simultaneously with drawing of the launching bowstring 20, completely readies the bow for firing. At the firing release of the bending and launching bowstrings 22, 20, release of the latching means is effected, allowing the limbs 16 to move to their restored positions.

The final draw of the bending and launching bowstrings 22, 20 also establishes a driving connection between each capstan 34 and an associated launching reel 24. Thus, upon release at firing of both bowstrings 20, 22 the launching bowstring 20 is snapped to the return position by movement of the limbs 16 and driving of the launching reels 24 by the capstans 34, in turn driven by the load cables 32 as these move rapidly outwardly with the limbs 16 in returning to their restored positions. The driving connection between the bending segment reels 30 and the capstans 34 is interrupted at the moment of release, so that the capstans 34 do not drive the bending segment reels 30 as the capstans 34 are rotated by unwinding of the load cables 32 caused by the limbs 16 moving to their restored position. Thus, all of the energy of the bent limbs 16 is released into the launching bowstring 20 to accelerate the fired arrow.

Accordingly, the stored energy created by the total limb bending produced by each of the preliminary and final bending drawings of the bending bowstring 22 is released at firing, accelerating the arrow with an impulse greatly increased over that which would be produced if the arrow was accelerated by the bending bowstring as in a conventional archery bow.

Figure 2B:
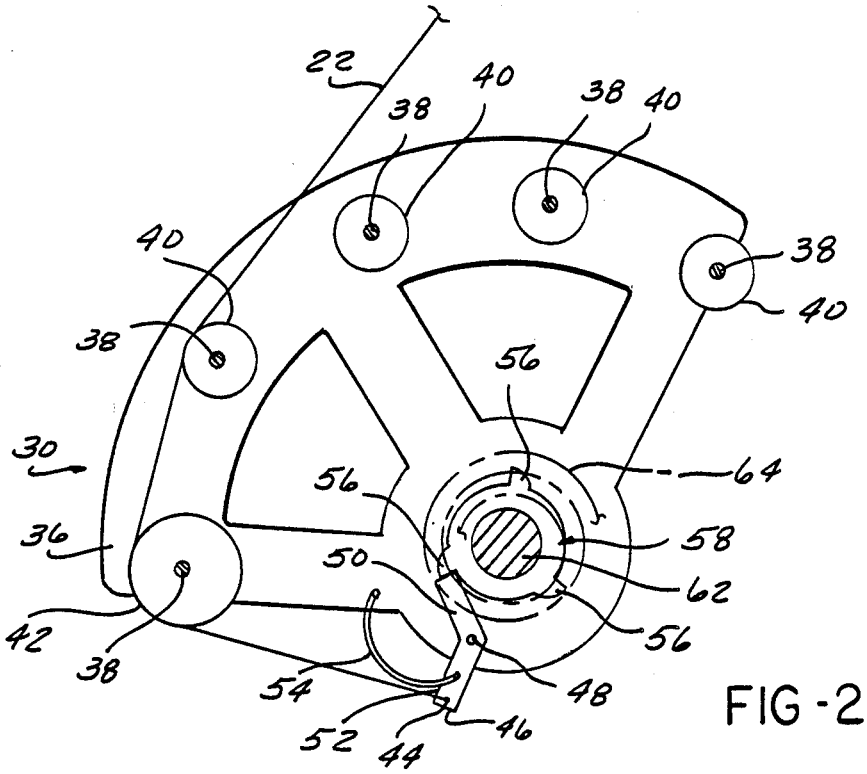
FIGS. 2*a* and 2*b* are side views of the bending segment reels and attached components incorporated in the archery bow shown in FIG. 1, depicting successive positions thereof.
Figure 2A:
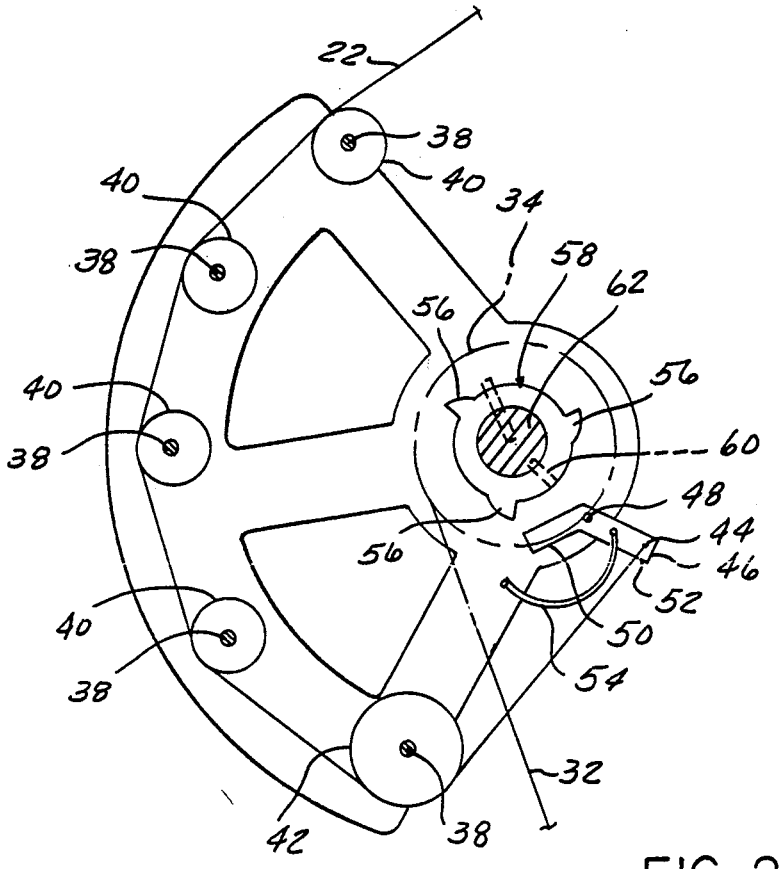
Figure 3A:
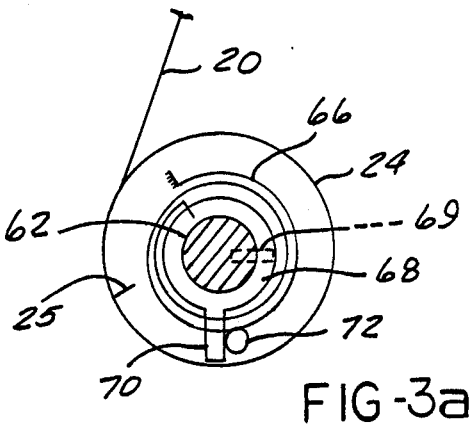
FIGS. 3*a*–3*d* are side views of one of the launching bowstring launching reels and related components incorporated in the archery bow shown in FIG. 1, depicting successive positions thereof.
Figure 3B:
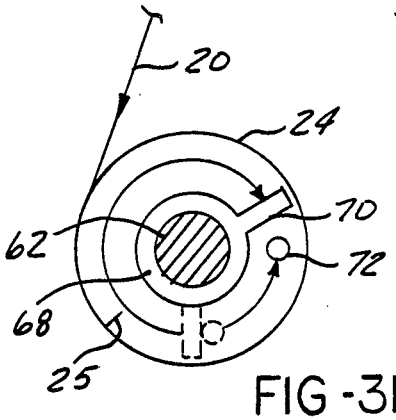
Figure 3C:
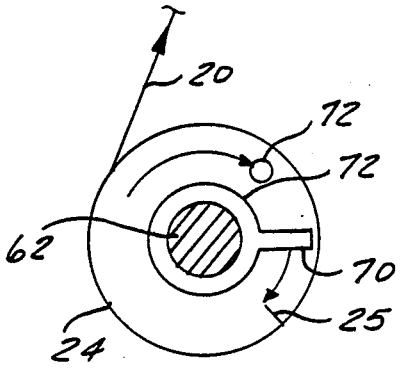
Figure 3D:
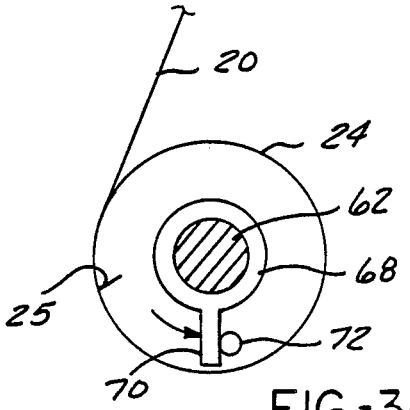
Figure 4A:
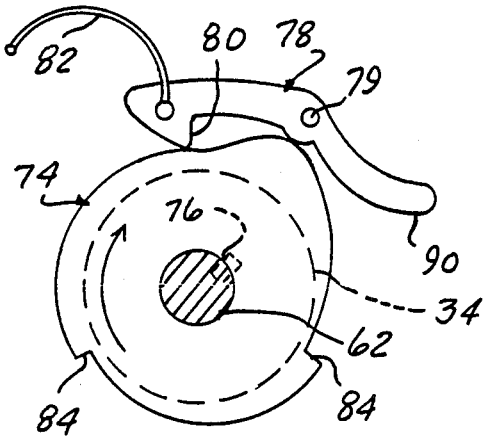
FIGS. 4*a* and 4*h* are side views of one of the latching discs incorporated in the archery bow shown in FIG. 1, depicting successive positions thereof.
Figure 4B:
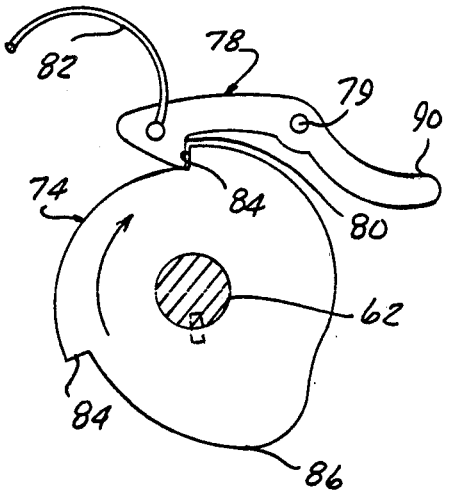
Figure 4C:
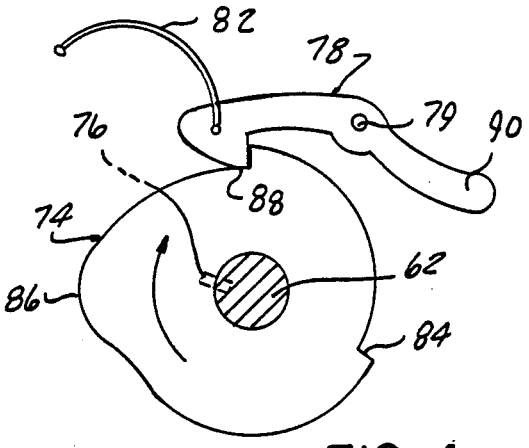
Figure 4D:
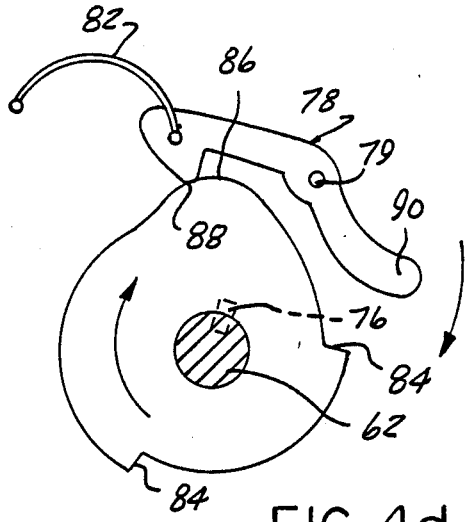
Figure 4E:
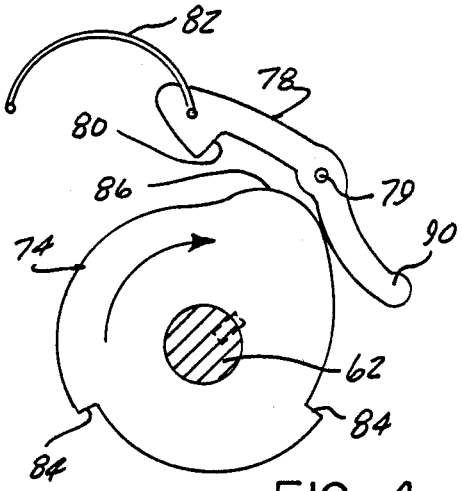
Figure 4F:
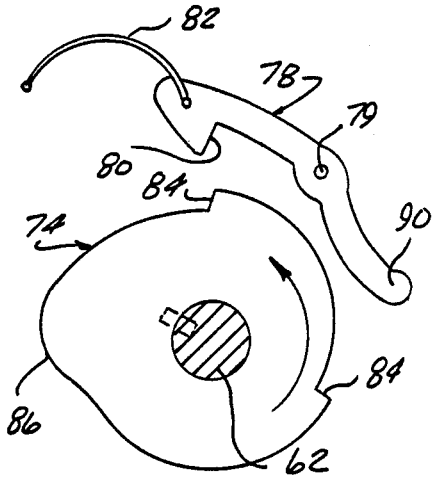
Figure 4G:
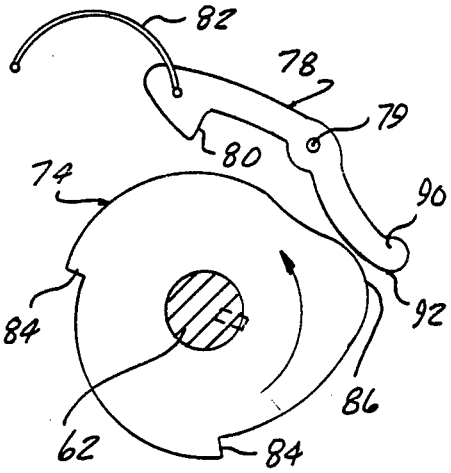
Figure 4H:
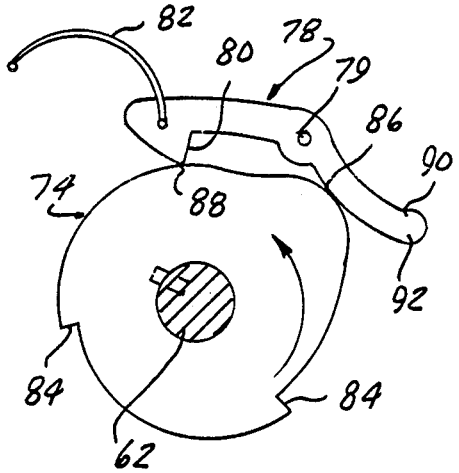

Referring to FIGS. 2*a* and 2*b*, an enlarged view of the bending segment reel 30 is shown with associated components. Bending segment reel 30 may be constructed with a pair of axially spaced side plates 36 connected with crosspins 38, on which are rotatably mounted rollers 40. Suitable lightening openings 42 may be provided in side plates 36.

The rollers 40 are spaced circumferentially to define a fixed radius periphery about which the bending bowstring 22 passes. The bending bowstring 22 passes around a pulley 42 mounted on a cross pin 38 at the end of the series and extends radially inwardly with the end connected at 44 to an angled pawl 46.

Pawl 46 is pivoted on the bending segment reel 30 with a pivot pin 48, and includes an angled blunt faced end portion 50 opposite the end 52 to which the bending bowstring 22 is attached. A leaf spring 54 is connected to end 52 of pawl 46 and to a side plate 36 to create a bias means urging the pawl 46 to the position shown in FIG. 2*a*, with end 50 rotated out of engagement with the teeth 56 of drive wheel 58.

The drive wheel 58 is keyed at 60 to rotate with an axle 62 connected to the capstan 34 and mounted to be rotatable on the bracket 28 (not shown in FIGS. (*2a* and *2b*).

Thus, with the tensioning of the bending bowstring 22 by initiation of drawing motion thereof, the bias means of leaf spring 54 is overcome and the pawl 46 is rotated so that the end 50 is able to engage one of the teeth 56 of the drive wheel 58 upon rotation of the bending segment reel 30. This produces corresponding rotation of the drive wheel 58 and connected axle 62, which is connected to the capstan 34.

Thus, the capstan 34 is rotated whenever the segment reel 30 is rotated clockwise as viewed in FIGS. *2a* and *2b*, by pulling of the bending bowstring 22 through a predetermined arc of rotation shown in FIG. *2b*.

Whenever the bending bowstring 22 is relaxed, the leaf spring 54 causes pivoting of pawl 46 out of engagement with teeth 56 to interrupt the driving engagement. Spring bias means are provided as by a clock spring 64 as shown in FIG. *2b*, resisting the clockwise rotation of bending segment reel 30 and returning the same to the start position shown in FIG. *2a* upon disengagement of the pawl 46.

FIGS. *3a–3b* illustrate the components associated with the upper launching reel 24 having the end of launching bowstring 20 wound thereon and affixed thereto at 25. The launching reel 24 is rotatably received on the axle 62, and is constantly urged to rotate counterclockwise by spring bias means constituted by clockspring 66 connected thereto. Thus, as the axle 62 is rotated clockwise by rotation of the bending segment reel 30 and slackening of the launching bowstring 20 occurs, counterclockwise rotation of the launching reel 24 takes place because of the action of clockspring 66, as shown in FIG. *3b*, winding up the launching bowstring 20 thereon.

The launching reel 24 and axle 62 are normally relatively rotatable with respect to each other. However, a collar 68 fixed to axle 62 at 69, has a drive tab 70 which engages a drive pin 72 fixed to the launching reel 24 after the preliminary bending draws are completed and after both bowstrings 20, 22 have been fully drawn. FIG. *3b* shows the position of the axle 62 and launching reel 24 after two draws of the bending bowstring 20 in which launching reel 24 has rotated counterclockwise, carrying drive pin 72 to the three o'clock position, and tab 70 has been rotated behind drive pin 72.

FIG. *3c* illustrates the simultaneous draw of both bowstrings 20, 22 in progress, with both tab 70 and drive pin 72 advancing clockwise, although at different rates.

This engagement between the capstans 34 and axles 62, and the launching reels 24 occurs only after completion of the final simultaneous draw of both bowstrings 20 and 22, since as shown in FIG. *3b*, drawing of the launching bowstring 20 causes rapid clockwise rotation of the launching reel 24, advancing drive pin 72 towards the rear face of drive tab 70. Drive tab 70 itself continues to advance clockwise with rotation of the axle 62, but more slowly due to the difference in effective radii of the bending segment reels 30 and capstans 24.

At full draw, as shown in FIG. *3d*, the drive pin 72 has advanced to engage the rear face of drive tab 70. Thus, unwinding rotation of the capstans 34 and attached axles 62 rotates the launching reels 24 counterclockwise to contribute to the rapid movement of the launching bowstring 20 to its normal position.

Thus upon release of axles 62 as described, the drive tabs 70 are rotated rapidly counterclockwise as shown in FIG. *3d*, driving pin 72 and rewinding the launching bowstring 20 onto the launching reel 24, to the return position shown in FIG. *3a*.

FIGS. *4a–4h* illustrate the latching means associated with the axle 62 to hold the capstans 34 after each of the preliminary drawing stages, and is not released until firing of the archery bow 10.

The latching means includes a rotary latching plate 74 keyed at 76 to be fixed to the axle 62.

A latching pawl 78 is pivoted at 79 to the bracket 28, to enable rocking movement of a latching face 80 towards and away from the periphery of the latching plate 74. A biasing leaf spring 82 is connected to the latching pawl 78 to urge the latching face 80 towards the periphery of latching plate 74.

A pair of latching recesses 84 are located at circumferentially spaced locations, formed into the latching plate 74, such that as the axle 62 is rotated, the latching pawl 78 rotates to move the face 80 into locking relationship with each recess 84. This prevents counter rotation of the axle 62 when the driving relationship between the bending segment reel 30 and the drive wheel 58 is interrupted at the end of each preliminary bending draw of the bending bowstring 22.

To accomplish this, the circumferential spacing of the recesses 84 apart from each other and from the initial position corresponds to the rotation of the axle 62 caused by each drawing motion of the bending bowstring 22, as indicated in FIGS. *4b* and *4c*.

After two preliminary bending draws, the third and final drawing motion of the bending bowstring 22 rotates the axle 62 to bring a cam lobe 86 formed on the latching plate 74 into engagement with the nose 88 on the end of the latching pawl 78 as shown in FIG. *4d*. This forces rotation of the latching pawl 78 away from the latching plate 74 sufficiently to move the line of action of the leaf spring 82 overcenter with respect to the pivot 79 to hold the latching pawl 78 entirely out of engagement with the latching plate 74, as shown in FIG. *4e*.

This allows the latching plate 74 to rotate counterclockwise as seen in FIG. *4f* after the bowstrings 20, 22 are released when the archery bow is fired. As the return rotation continues a curved camming surface 92 formed on the other end 90 of the latching pawl 78 comes into engagement with camming lobe 86. This forces the latching pawl 78 to rotate counterclockwise as shown in FIG. *4h* until the line of action of the leaf spring 82 again moves overcenter with respect to the pivot 79, to again urge the face 80 towards the latching plate 74, as in the initial position shown in FIG. *4a*.

Accordingly, it can be appreciated that the archery bow 10 described allows a much greater force to be applied to an arrow for a given maximum draw effort. The bending of the limb tips for a given drawing motion of the bending bowstring is much less than that for the same motion of the launching bowstring—hence a high degree of leveraging for the bending bowstring is achieved. The increased drawlength resulting is accomplished over several drawing motions, using the latching means to hold the bending for each previous draw. This reduced effort effect can be used to compensate for reduced user capability, or to provide substantially higher performance archery for a user of normal capacities by keeping the effort at the same level as conventional bows. The cross limb arrangement of the preload cables insures coordinated limb bending such that accurate arrow release is insured.

The components comprise simple rotary elements, which should be troublefree, and able to be manufactured at moderate cost, and do not unduly increase the complexity of the device.

It is noted that while the rotary elements are described as concentrically configured, eccentric configurations are possible to provide a reduced effort at full draw, as is described in U.S. Pat. No. 3,486,495. In this case, the cross connection of the load cables 32 to the limb tips remote from the capstan 34 on which it is wound provides the coordinate bending of the limbs 16 by the cross leveraging effect thus provided.

It is noted however, that the use of the bending segment reels 30 of greater size than the capstans 34, does provide a pronounced mechanical advantage which is exerted to aid in holding the bowstrings 20, 22 at full draw until release. It will be apparent the various components must be appropriately sized to produce the result described. Essentially, the bow member 12 and launching bowstring 20 are sized to accommodate a full normal draw thereof, with a portion of the draw made up by unwinding of launching bowstring 20 off the launching reels 24. Thus the bending segment reels must be sized to produce a matching bending of limbs 16.

The use of the launching reels 24 allows the use of a shorter length bow member while still accommodating a full draw of the launching bowstring. That is, part of the travel of the center of the bowstring is made up by unwinding of the launching bowstring from the launching reels, and part by the bending of the limbs as the bending and launching bowstring are drawn. This allows a shorter length bow member since the limbs do not have to bend as sharply.

Figure 5B:
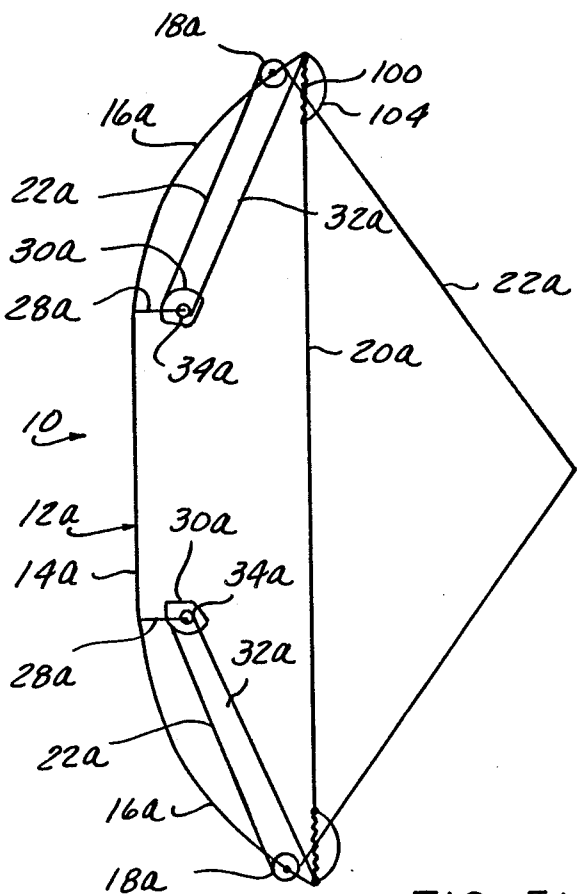
FIGS. 5*a* and 5*b* are diagrammatic representations of an alternate embodiment of an archery bow according to the present invention, shown in the undrawn (5*a*) and drawn (5*b*) conditions.
Figure 5A:
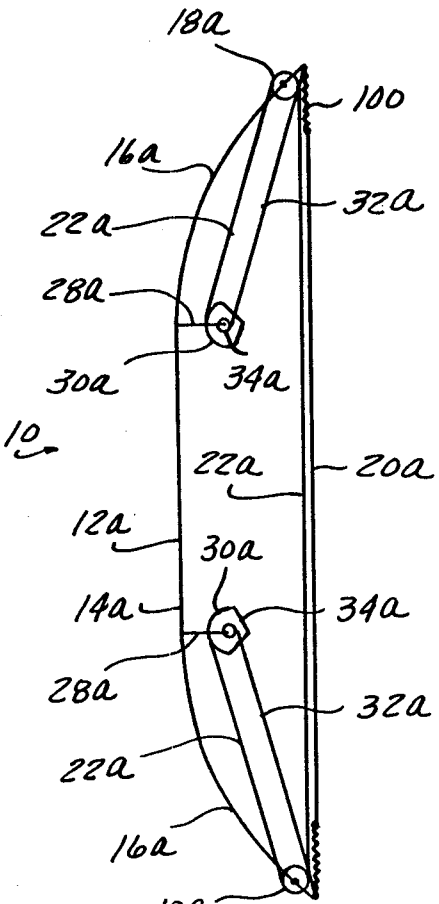

FIGS. 5*a* and 5*b* depict an alternate embodiment of an archery bow 10*a* which does not incorporate launching reels, and thus must use a bow member 12*a* of longer length since the limbs 16*a* must bend somewhat further to accommodate full draw of the launching bowstring 20*a*.

In this embodiment, the bending bowstring 22*a*, as before, passes about pulley 18*a* mounted to each limb tip, and each end extends and is attached to the periphery of a bending segment reel 30*a*, mounted on a bracket 28*a*. Load cables 32*a* are each attached at one end to a limb tip and at the other to a capstan 34*a* to be wound thereon by rotary movement of the bending segment reels 30*a* and bend the limbs 16*a* in the above described embodiment. The bending segment reels 30*a* in this case should be of somewhat smaller diameter to match the draw of the bending bowstring to that of the launching bowstring with the increased bending of the bow member produced by the absence of the take up reels. The launching bowstring 22*a* is directly connected to the limb tips, rather than to launching reels.

Thus, as the bow member 12*a* is bent by the bending draws of the bending bowstring 22*a*, slack will develop in the launching bowstring 20*a*. This slack may be taken up by shortening tension springs 100 connected to each tip at one end and to an intermediate point 102 along the length of the launching bowstring 22*a*. Thus, as slack develops, small loops 104 will form in the launching bowstring 20*a* to maintain the main length thereof taut, as shown in FIG. 5*b*.

I claim:

1. An archery bow comprising:

a bow member having a central handle section and a pair of resilient limbs terminating in limb tips at either end of said bow member;

a launching bowstring mounted extending between the tips of said limbs;

a bending bowstring having a central segment thereof mounted to extend outwardly towards the tips of said limbs and lying parallel to said launching bowstring, and a connecting segment extending from each side of said central segment;

pulley means on either limb passing a respective connecting segment of said bending bowstring extending from each end of said central segment outwardly and back towards said handle section;

a pair of rotary bending mechanisms mounted to said bow member at lengthwise locations inward of said limbs of said bow member, each of said bending mechanisms including a rotatably mounted capstan element;

a pair of bending cables each affixed at one end to a respective limb tip and attached at the other end to a respective capstan element to be wound thereon upon rotation thereof in one direction, to thereby bend said limbs by shortening of said bending cables;

a rotary bending element included in each bending mechanism, each rotary bending element connected to an end of a respective one of said connecting segments of said bending bowstring to be operated by drawing motion thereof, and engagement means acting between each of said rotary bending elements and a respective capstan element to cause rotation thereof by drawing of said bending bowstring, said rotary bending elements being configured to exert a mechanical advantage in rotating said capstan elements to reduce the bowstring pull required to create a given tension level in said bending cables;

latching means acting to hold each of said capstan elements in a wound condition after at least one drawing motion of said bending bowstring;

means for releasing said latching means after completion of said bending of said limbs and a final drawing motion of said bending and launching bowstrings, whereby the returning motion of said bent limbs is exerted on said launching bowstring by unwinding of said capstans allowing return motion of said limbs.

2. The archery bow according to claim 1 wherein said launching bowstring includes segments, one each mounted to a respective limb tip; and further including a pair of rotatably mounted launching reels, each having wound thereon a respective end of said launching bowstring;

bias means urging each of said launching reels to rotate to wind up slack generated by bending of said limbs by said bending mechanisms.

3. The archery bow according to claim 2 wherein each of said reels and said axles carries a drive feature engageable with each other to establish a rotary driving connection therebetween in a relative rotational initial position of said respective launching reels and axles; wherein said launching reel and axle features rotate away from each other in opposite directions as said capstan is wound by said bending bowstring during bending, and wherein said feature on said launching reel moves to overtake said axle feature upon full drawing of said launching bowstring.

4. The archery bow according to claim 1 wherein each of said rotary bending elements comprises a bending segment reel of a substantially larger radius than said capstan elements and receiving each end of said bending bowstring wound therearound, and adapted to allow unwinding of a length of said bending bowstring with each of said bending drawing motions and further including spring bias means resisting rotation of each bending segment reel in a direction to unwind said bending bowstring and acting to rewind said length of bending bowstring unwound by said drawing motion thereof.

5. The archery bow according to claim 4 wherein each of said bending mechanisms includes a rotary axle connected to said capstan element, and wherein said engagement means comprises means establishing a driving connection between each of said bending segment reels and a respective axle upon drawing of said bending bowstring, and disestablishing said driving connection whenever said bending bowstring is not tensioned whereby said bending segment reels rotate to the return position.

6. The archery bow according to claim 5 wherein each of said bending segment reels is mounted on said axles, and wherein each of said bending mechanisms further including a pawl pivoted to each bending segment reel, a toothed drive disc connected to each axle, and means causing said pawl to engage said drive disc only when said bending bowstring is under tension to establish a driving connection between said bending segment reel and said axle.

7. The archery bow according to claim 6 wherein each of said bending segment reels comprises approximately a half segment of a circle disposed on the side of the axis of rotation thereof adjacent said handle section of said bow member.

8. The archery bow according to claim 1 wherein said latching means includes a pair of latching plates each drivingly connected to a respective capstan element to rotate therewith, and at least one engagement surface formed thereinto, a pivoted latching pawl disposed to have a corresponding engagement feature move into engagement with said latching plate engagment surface to be latched thereto and prevent further rotation of said latching plate, and means normally biasing said pawl to move said engagement feature thereof towards said latching plate, and wherein said means releasing said latching means comprises means reversing said biasing means to urge said pawl engagement feature away from said latching plate.

9. The archery bow according to claim 8 wherein said bias means comprises a leaf spring attached at one end to each latching pawl and moved overcenter by said means reversing said biasing means.

10. The archery bow according to claim 9 wherein said means reversing said biasing means comprises cam surfaces formed on each of said latching pawls and latching plates pivoting said latching pawls engagement feature away from said respective latching plate engagement surface upon continued rotation of said latching plate.

11. The archery bow according to claim 1 wherein each of said rotary bending elements is of substantially larger diameter than said capstans, whereby a leveraged rotation of said capstans occurs upon drawing of said bending bowstring.

12. The archery bow according to claim 1 wherein each of said bending cables is connected to the capstan most remote from the tip to which said cable is attached, whereby coordinated limb bending is produced.

13. The archery bow according to claim 1 wherein said launching bowstring is attached directly at each end to said limb tip.

14. The archery bow according to claim 13 wherein said load cables are each connected to a limb tip on the same end as said bending mechanism.

15. The archery bow according to claim 13 further including at least one tension spring connected to a limb tip at one end and to an intermediate point along the length of said launching bowstring to take up the slack developing upon bending of said limbs.

16. An archery bow comprising an elongated bow member having flexible limbs at either end each ending in limb tips at said either end of said bow member;

a launching bowstring extending between the tips of said limbs;

a bending bowstring extending between the tips of said limbs;

bending means increasingly bending said limbs with successive draws of said bending bowstring and holding said limbs in a bent condition after each of a predetermined number of preliminary draws of said bending bowstring; release means for releasing said limbs after a final drawing and releasing of said bending bowstring simultaneously with a drawing and releasing of said launching bowstring to enable an arrow nocked on said launching bowstring to be fired.

17. The archery bow according to claim 16 wherein said bending means includes leveraging means causing a corresponding smaller limb bending by drawing motion of said bending bowstring than by said launching bowstring, whereby a reduced draw effort is required in drawing said bending bowstring than exerted by said launching bowstring at firing of an arrow.

18. The archery bow according to claim 16 further including slack take up means acting on said launching drawstring to maintain said launching bowstring taut as said limbs are bent by said bending means.

19. The archery bow according to claim 18 wherein said release means is responsive to a predetermined number of draws of said preloading bowstring.

* * * * *

UNITED STATES PATENT AND TRADEMARK OFFICE

CERTIFICATE OF CORRECTION

PATENT NO. : 4,757,799

DATED : July 19, 1988

INVENTOR(S) : John W. Bozek

It is certified that error appears in the above-identified patent and that said Letters Patent is hereby corrected as shown below: Title page:

In the title, "ARCHERY BOX WITH LEVERAGED BENDING BOWSTRING AND SEPARATE LAUNCHING BOWSTRING" should be --ARCHERY BOW WITH LEVERAGED BENDING BOWSTRING AND SEPARATE LAUNCHING BOWSTRING--

Column 1, line 13, "drawstring" should be --bowstring--.

Column 1, line 41, "drawstring" should be --bowstring--.

Column 2, line 20, "would" should be --wound--.

Column 3, line 25, "respectoive" should be --respective--.

Column 5, line 60, "24" should be --34--.

Column 10, line 50 (Claim 18), "drawstring" should be --bowstring--.

Signed and Sealed this

Twenty-seventh Day of December, 1988

*Attest:*

DONALD J. QUIGG

*Attesting Officer*

*Commissioner of Patents and Trademarks*